United States Patent [19]

Landfors

[11] 4,140,438

[45] Feb. 20, 1979

[54] DIFFUSION PUMP

[75] Inventor: Arthur A. Landfors, Sharon, Mass.

[73] Assignee: Varian Associates, Inc., Palo Alto, Calif.

[21] Appl. No.: 702,654

[22] Filed: Jul. 6, 1976

[51] Int. Cl.[2] ..... F04F 9/00

[52] U.S. Cl. ..... 417/153; 417/154

[58] Field of Search ..... 417/152–154, 417/87, 51

[56] References Cited

U.S. PATENT DOCUMENTS

| | | | |
|---|---|---|---|
| 1,330,556 | 2/1920 | Shrader | 417/153 |
| 1,791,105 | 2/1931 | Seitz | 417/154 |
| 2,386,299 | 10/1945 | Downing | 417/153 X |
| 2,404,021 | 7/1946 | Alexander et al. | 417/154 X |
| 2,438,387 | 3/1948 | Colaiaco | 417/154 |
| 2,447,636 | 8/1948 | Colaiaco et al. | 417/154 |
| 2,709,034 | 5/1955 | Lawrance et al. | 417/154 X |
| 3,203,624 | 8/1965 | Smith, Jr. | 417/154 |
| 3,362,623 | 1/1968 | Landfors | 417/154 |

*Primary Examiner*—Carlton R. Croyle

*Assistant Examiner*—Edward Look

*Attorney, Agent, or Firm*—Stanley Z. Cole; Leon F. Herbert; Edward H. Berkowitz

[57] ABSTRACT

A diffusion pump, particularly adapted to pump light gases at a constant rate, includes a flow path for condensate from a cool wall of a body assembly to a region substantially in the center of a liquid pool of vaporizable diffusion pump liquid. Heat to vaporize the liquid in the pool is applied to a peripheral side wall of the pool so that vapor rises from the periphery of the pool to a jet assembly, from which the vapor is emitted through nozzles against the cool wall. The jet and body assemblies are mounted on a shelf above the surface of the pool and are substantially thermally isolated from a heat source for the pool. A fore line includes a plurality of baffle plates that are substantially thermally isolated from the cool wall by a vacuum space. The baffle plates are warm enough to boil away substantially all high vapor pressure materials contacting them, yet cool enough to condense the diffusion pump fluid vapor that contacts them, whereby the condensed vapors in the fore line flow back to the pool.

26 Claims, 2 Drawing Figures

DIFFUSION PUMP

FIELD OF INVENTION

The present invention relates generally to diffusion pumps and more particularly to a diffusion pump wherein condensate flows to a region of a liquid pool located remotely from the heated periphery of the pool.

BACKGROUND OF THE INVENTION

Diffusion pumps are characterized by a liquid pool of vaporizable diffusion pump fluid that is heated by a boiler to a vapor that rises through a jet assembly, and thence is emitted through at least one, and usually several, nozzles against a cool wall. The vapor is condensed on the cool wall to form a condensate that flows downwardly back to the periphery of the pool and thence inwardly toward the center of the pool due to convection currents in the pool. Most small diffusion pumps have heat applied to the pool from a source having a heating surface extending along the entire bottom of the pool. Usually, the heat source includes a flat electric heater that heats a metal plate having an upper surface which forms the bottom of the pool.

In the typical boiler, the vaporizing process tends to be uneven as convection currents in the pool are random, having horizontal and circular components that tend to be circular to cause local superheating of the fluid in the pool. In the areas of local superheating there is sudden and explosive boiling that changes the boiler pressure and the rate at which the liquid is vaporized and supplied to the jet assembly. The variations in the rate at which liquid is boiled from the pool are reflected in changes in speed of the pump and have a tendency to produce unstable pressure in a vacuum chamber being evacuated. If the vacuum load is a light gas, such as helium, the pressure instability may be particularly noticeable.

In one modified boiler, convection currents are relatively uniform and cause the liquid to flow from the periphery of the pool toward the center of the pool without local superheating of the liquid in the pool or pressure instability. This modified structure employs a heater having a cylindrical heating surface that is located in close proximity to the center of the pool and extends vertically through the pool. The heater is surrounded by a thin, annular shell having an open bottom so that cool liquid at the bottom of the pool enters an annular space between the shell and heater. The cool liquid is heated to a vapor as it rises through the annular space.

The basic problem with the modified boiler employing a central cylindrical heating surface is that it has a small heating surface, due to the relatively small radius of the cylindrical heater. To vaporize the liquid, the heat density (watts per square centimeter) on the surface of the cylinder must be very high, resulting in high temperatures in the annular region between the cylindrical heater and shell. The temperatures in the annular region are so high that there is a high probability of the fluid in the pool decomposing which adversely affects the ultimate pressure to which a chamber can be pumped.

A further disadvantage with the central, cylindrical heater is that the heater temperature becomes so high that an electrical heating element within the cylindrical heater has a tendency to become seized inside the cylinder. If the heating element is seized inside of the cylinder, removal of the heating element, when replacement is necessary, is very difficult and usually involves drilling out the heater element. The inner surface of the cylinder may be damaged by drilling, resulting in a poor contact between the new heater element and the cylinder wall.

It is, accordingly, an object of the present invention to provide a new and improved diffusion pump particularly adapted to pump light gases at a constant rate.

An additional object of the invention is to provide a new and improved diffusion pump wherein convection currents in a liquid being vaporized from a pool are relatively uniform and are not random.

An additional object of the invention is to provide a new and improved diffusion pump including a boiler wherein liquid is vaporized uniformly from a pool so that pressure of the vapor above the pool remains relatively constant.

An additional object of the invention is to provide a new and improved diffusion pump having a relatively constant speed and therefore relatively great pressure stability so that it is particularly adapted for use in connection with the pumping of light gases, such as helium.

Yet another object of the invention is to provide a new and improved diffusion pump employing a boiler having relatively uniform convection currents, and a heating surface with a relatively low watt density.

Still another object of the invention is to provide a new and improved diffusion pump wherein convection currents in a pool of liquid are relatively uniform and fluid in the pool does not have a tendency to decompose as a result of excessive temperatures being applied to it.

Yet a further object of the invention is to provide a new and improved diffusion pump having relatively uniform convection currents in a liquid pool and wherein a chamber can be pumped to a high vacuum, on the order of $6 \times 10^{-9}$ torr.

Still another object of the invention is to provide a new and improved diffusion pump wherein relative uniform convection currents flow through a pool of liquid that is vaporized by a heat source which includes a heating element that is relatively easily replaced.

BRIEF DESCRIPTION OF THE INVENTION

In accordance with the present invention, the flow path for condensate is from a cool wall of a body assembly of a diffusion pump to a region in a liquid pool of vaporizable diffusion pump fluid that is located remotely from the periphery of the pool. Heat is applied to the liquid in a portion of the pool remote from the region so that the heated liquid forms a vapor that rises through a jet assembly and thence is emitted through at least one nozzle against a cool wall, where it forms the condensate that flows downwardly back to the pool. Heat is applied to the pool by a vertically extending wall that extends about the periphery of the pool so that a substantial volume of the pool is heated and excessive heat is not applied to the fluid; also, the design is such that seizing of any of the boiler parts does not occur.

Substantially uniform, unidirectional convection currents flow radially outwardly toward the periphery of the pool, from a central region of the pool where cool condensate flows into the pool, toward the pool portion where the heat is applied to the pool. The unidirectional convection flow is provided by the peripheral heating and by inserting in the pool a downwardly and outwardly extending, tapered annular fluid passageway having a cross-sectional flow area that decreases with increasing vertical distance from the surface of the pool, i.e., as the pool gets deeper, the cross-sectional flow area for the liquid decreases. The fluid, after flowing outwardly and downwardly through the passageway in the pool, rises while being heated to vaporization in an annular region defined by the outside of the fluid passageway and the pool periphery.

In contrast to most diffusion pumps, the jet assembly of the present invention is mounted completely above the surface of the pool, and is substantially thermally isolated from the boiler. This is because the fluid passageway for the condensate to the central region of the pool occupies the space where the typical jet assembly fractionating tube (that supplies a first diffuser stage with liquid boiled from the center of the pool) dips into the pool. Because a fractionating tube cannot be employed, there is a tendency for impurities in the pool to be vaporized and for these impurities to flow to the first stage, with a resulting higher pressure in a chamber being pumped. To decrease impurities in the pool, and consequently, in the vapor stream of the diffusion nozzle stages, the impurities are boiled off in the fore line and pumped out of the diffusion pump by the fore pump; hence, few of the impurities migrate back to the pool. Boiling in the fore line is achieved by thermally isolating a fore line baffle from the cool walls of the fore line and body assembly. The temperature of the fore line baffle is sufficiently high to boil away substantially all high vapor pressure materials that contact the baffle, while condensing the low vapor pressure diffusion pump fluid which contacts the baffle surfaces. The condensed diffusion pump fluid flows from the baffle through the fore line to the central region of the pool via the same fluid flow path as exists between the body assembly wall and the pool. When the thermally isolated baffle was replaced by a conventional baffle having plates in abutment with the cool fore line, the ultimate pressure in the chamber rose by a factor of ten from $6 \times 10^{-9}$ torr to $6 \times 10^{-8}$ torr. Of course, it is desired to maintain the fore line relatively cool to prevent damage to a flexible rubber tube that sealingly connects the fore line to a fore pump.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 1:
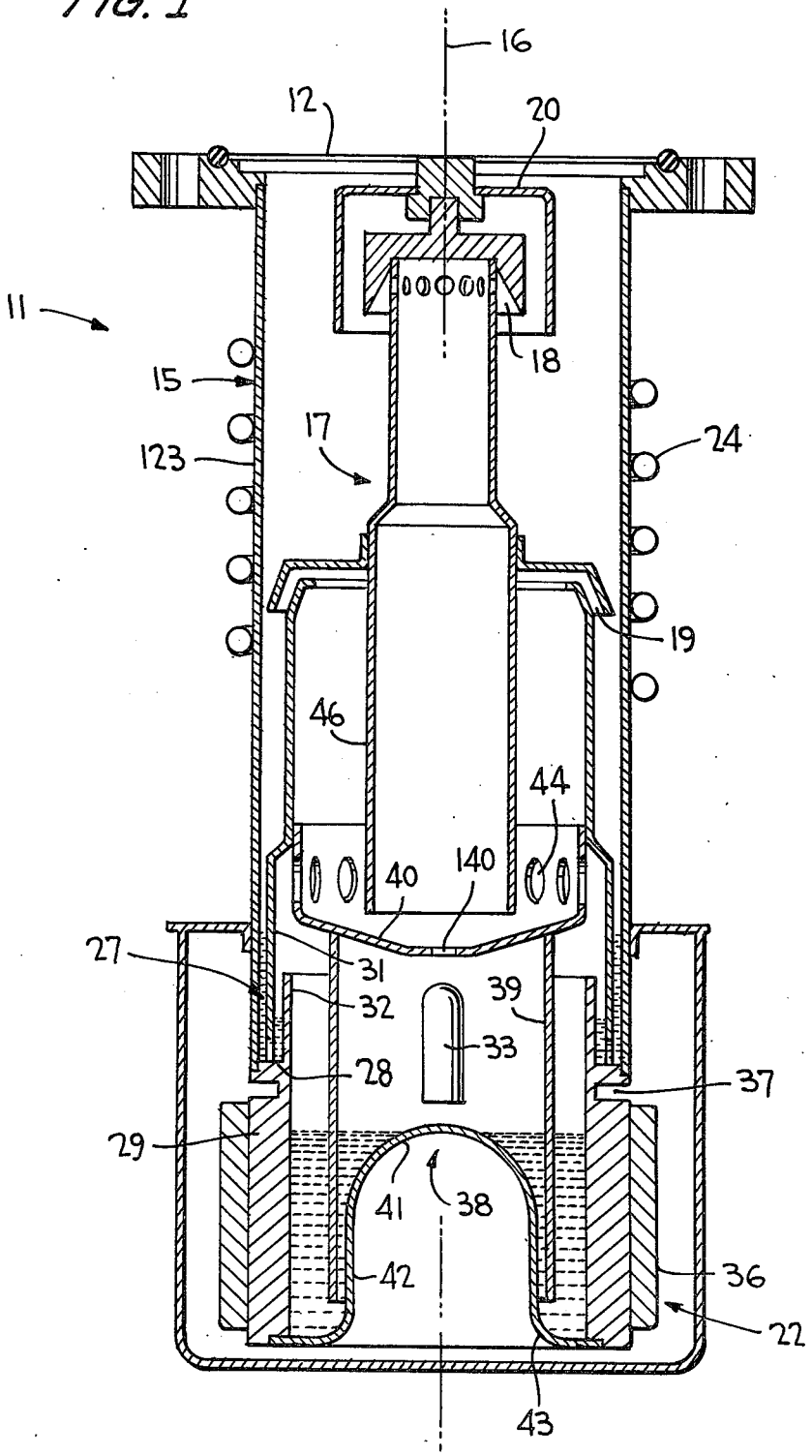
FIG. 1 is a side, sectional view of a preferred embodiment of the invention.
Figure 2:
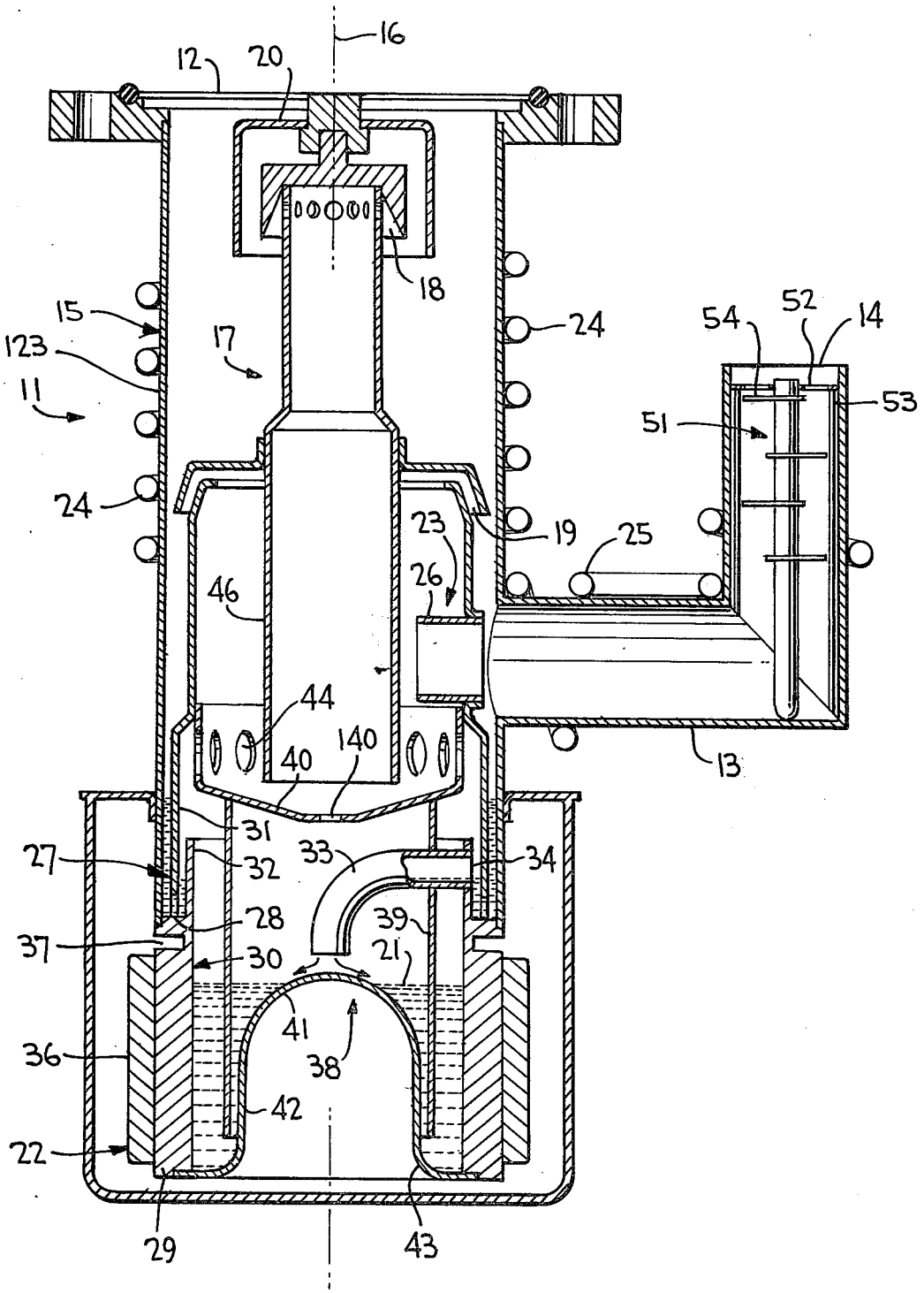
FIG. 2 is a sectional view, taken at right angles to the view of FIG. 1.

Reference is now made to the Figures wherein there is illustrated a diffusion pump 11 having an inlet opening 12 connected in fluid flow relationship to a suitable vacuum chamber (not shown) preferably including a light gas such as helium. Pump 11 includes a fore line 13 that is connected via opening 14 to a fore pump (not shown).

Pump 11 includes a cylindrical body assembly 15 having a longitudinal, centrally located axis 16. Concentric with axis 16 is a jet assembly 17 including a first diffuser nozzle stage 18 and a second diffuser nozzle stage 19. Mounted concentrically about and above first stage 18 is cold cap 20, which is in close proximity to opening 12. Located below jet assembly 17, at the bottom of pump 11, is a liquid pool 21 of a standard diffusion pump fluid or oil. The fluid in pool 21 is vaporized by a heater assembly 22 that forms a peripheral, vertical wall of the pool. A third, ejector stage 23 is provided between the interior of jet assembly 17, below the second diffusion stage 19, and fore line 13 to pump the gas received from second stage 19 into the fore line.

To condense vapor molecules that are downwardly ejected by stages 18 and 19 against body assembly 15, wall portion 123 of the body assembly is cooled by coil 24 that is bonded to the exterior surface of the body assembly. In response to the oil-vapor stream or jet from nozzles included in stages 18 and 19 striking portion 123, the fluid in the stream is condensed to form a condensate that flows downwardly along the interior wall of body assembly 15, with the condensed oil being returned to pool 21. Similarly, the wall of fore line 13 is wrapped with a cooling coil 25 so that vaporized oil which expands as it flows through cylindrical nozzle 26 of ejector stage 23 is condensed when it strikes the wall of the fore line. The condensed molecules on the wall of fore line 13 flow back to body assembly 15 and thence to pool 21.

The downward flow of condensed liquid along the interior surface of body 15 to pool 21 is via a flow path including reservoir 27. Reservoir 27 is formed in an annular space extending above shelf 28 of annular, metal cylinder 30, the lower wall 29 of which has an interior face that forms the peripheral wall for pool 21. The bottom edge of downwardly depending cylindrical skirt 31 of jet assembly 17 rests on shelf 28 and includes apertures for enabling fluid to flow radially inward from an outer region of reservoir 27 between the skirt and body assembly 15 to an inner region of the reservoir between the skirt and a relatively narrow, upwardly extending wall 32 of cylinder 30. Liquid in the inner region of reservoir 27 flows into pool 21 via return tube 33 that extends into the inner region of the reservoir through aperture 34 in wall 32. The liquid in reservoir 27 acts as a seal to prevent vapor acting against the upper surface of the inner region of the reservoir from causing bubbling in the outer region of the reservoir. The height of the liquid in the inner region of reservoir 27, determined by the height of tube 33 above shelf 28, is sufficient to form the seal. Tube 33 is located so that its outlet orifice is substantially on center line 16 and is below aperture 34, whereby the liquid flows downwardly and radially inwardly from reservoir 27 through tube 33 to pool 21.

Liquid flows from the outlet orifice of return tube 33 outwardly and downwardly in pool 21 since unidirectional convection currents are established in the pool. The unidirectional convection currents are established, inter alia, by heating peripheral wall 29 along a vertical distance that extends from the bottom of pool 21 to above the surface of the pool. To this end, an electrical heating coil 36 surrounds the outside of wall 29 that transfers heat to the periphery of the pool which is defined by the wall. To substantially thermally isolate the fluid in reservoir 27 from heated wall 29, a high impedance thermal flow path is provided between walls 29 and 32 by circular groove 37 that extends completely around cylinder 30. Thereby, fluid in reservoir 27 does not boil, but remains in a relatively cool liquid state and flows through tube 33 back to pool 21.

The unidirectional convection currents in pool 21 are also established by an annular, tapered fluid flow path that extends downwardly and outwardly through the pool along dome 38, having an upper semi-hemispherical portion 41 with an apex on axis 16 immediately below the output orifice of tube 33. The flow area of the fluid path decreases as the vertical distance from the surface of pool 21 increases by providing a downwardly depending cylindrical separator sleeve 39 that extends from splash baffle 40 of jet assembly 17. Baffle 40 is a liquid-vapor separator that prevents liquid droplets in pool 21 from reaching stages 18, 19 and 23, but includes a small central aperture 140, on axis 16, through which condensed diffusion pump fluid flows back to pool 21.

The liquid flow path in pool 21 is through an annular orifice between straight section 42 of dome 38 and separator sleeve 39. The straight section 42 extends tangentially from semi-hemispherical portion 41 of the dome, as a cylinder concentric with axis 16. The fluid emerging from the orifice between separator 39 and straight section 42 flows downwardly and outwardly along a flow path having a boundary defined by arcuate, outwardly flared, annular section 43 of the dome. From dome section 43, the fluid flows upwardly through an outer, annular region of pool 21 between separator 39 and wall segment 29, where it is heated to vaporization. The vapor flows upwardly to stages 18, 19 and 23 through flow paths including apertures 44 immediately below ejector stage 23 in vertical wall of jet assembly 17. The radial flow paths through apertures 44 cause a sudden change in the flow direction of the diffusion pump fluid so that only vapor passes through the apertures and liquid is deposited on the exterior of the wall in which the apertures are formed.

The vapor flows through apertures 44 and upwardly, directly to second stage nozzle 19 that directs it downwardly against cool wall portion 123. In contrast, the vapor flow from apertures 44 to the first stage 18 above baffle 40 is through cylindrical column 46 that is coaxial with axis 16 and has an opening immediately above baffle 40 and below apertures 44. I have found, through experimentation, that this position for the opening of column 46 results in a lower pressure in the vacuum chamber than is attained with an opening immediately below nozzle 19 and above apertures 44. I am not certain of why this improvement occurs, but speculate that it is due to the tortuous path that exists from apertures 44 to nozzle 18 and which reduces the contaminates that can migrate to nozzle 18.

Because a fractionating tube or column for the first stage cannot be employed in the present invention, there is a tendency for a greater amount of impurities to arrive at first stage 18. To reduce impurities in pool 21 and at first stage 18, baffle plate assembly 51 inside of fore line 13 is maintained at a relatively high temperature. In particular, baffle plates 54 of assembly 51 have no cold surfaces so that high vapor pressure materials that contact the plates are boiled away, while the low vapor pressure diffusion pump fluid is condensed when it strikes the plates. Baffle plates are thermally isolated from the walls of fore line 13 and body assembly 15 by providing a vacuum space between the baffle plates 54 and the fore line wall; spacing is provided by dimpling cylindrical sleeve 53 that forms an interior liner for the vertically extending part of fore line 13. The dimples provide a small contact area with the cool fore line, to provide the desired thermal isolation. Fore line 13 is cooled to prevent damage to a flexible rubber sealing hose (not shown), on the outside of the fore line; the hose connects the fore line to the fore pump. A Truarc retaining ring 52 holds assembly 51 in place. It has been found that by providing a relatively hot baffle assembly 51, the pump of the present invention is able to evacuate a vacuum container to a pressure of $6 \times 10^{-9}$ torr; if a conventional baffle plate assembly, having cold baffle plates contacting the cold fore line wall, is employed, the maximum vacuum in the vacuum chamber is $6 \times 10^{-8}$ torr.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A diffusion pump wherein liquid from a pool of diffusion pump fluid is heated by a boiler to a vapor that rises through a jet assembly and thence is emitted through a nozzle means against a cool wall where it is condensed to form a condensate that flows downwardly along the wall back to the pool, the improvement comprising means for providing a flow path for the condensate from the cool wall to a region in the pool located remotely from the periphery of the pool, the boiler including means for applying heat to liquid in a portion of the pool remote from the region so that the liquid in the pool portion forms the vapor that rises, means for providing a substantially unidirectional thermal gradient whereby there is encouraged a substantially uniform convection flow of the condensate through the pool from the region toward the pool portion.

2. The pump of claim 1 wherein the heat is applied for a substantial vertical distance along the periphery of the pool.

3. The pump of claim 2 wherein the means for applying the heat extends from the bottom of the pool to above the surface of the pool.

4. The pump of claim 1 wherein said substantially uniform convection flow is constrained by means including a downwardly and outwardly extending fluid passageway.

5. The pump of claim 4 wherein the passageway is tapered to have a cross-sectional flow area that decreases with increasing vertical distance from the surface of the pool.

6. The pump of claim 1 wherein the jet assembly is mounted completely above the surface of the pool and is substantially thermally isolated from the means for applying heat.

7. The pump of claim 6 wherein the condensate flow path includes means for forming a reservoir of the condensate on the wall, the jet assembly having its lower portion immersed in the reservoir.

8. The pump of claim 6 wherein the jet assembly includes a conduit providing a flow path for the vapor to a diffusion nozzle of the nozzle means, the conduit having an opening below apertures in the jet assembly through which the vapor passes so that a tortuous path is provided for the vapor from the apertures to said diffusion nozzle.

9. The pump of claim 6 further including a fore line adapted to be connected to a fore pump, said fore line including a cool wall and a plurality of baffle plates substantially thermally isolated from the cool walls of the fore line and body assembly so that the baffle plates are warm enough to boil away substantially all high vapor pressure materials contacting them while condensing the diffusion pump fluid vapor contacting them, and means for providing a flow path for the condensed vapor from the plates to the pool.

10. The pump of claim 1 further including a fore line adapted to be connected to a fore pump, said fore line including a cool wall and a plurality of baffle plates substantially thermally isolated from the cool walls of the fore line and body assembly so that the baffle plates are warm enough to boil away substantially all high vapor pressure materials contacting them while condensing the diffusion pump fluid vapor contacting them, and means for providing a flow path for the condensed vapor from the plates to the pool.

11. A diffusion pump comprising a body assembly including a cool wall having a longitudinal, centrally located axis, a cylindrical heater having a heating wall coaxial with the body assembly and surrounding a pool of liquid that the heater vaporizes to a vapor, a jet assembly coaxial with the body assembly, means for providing a flow path for the vapor from the surface of the pool to the jet assembly, the jet assembly including at least one annular nozzle concentric with the axis for directing the vapor downwardly against the cool wall, the cool wall condensing the vapor striking it into a liquid that flows downwardly along the body assembly toward the pool, means for providing a flow path for the condensed liquid from the body assembly to a region substantially on the axis and thence outwardly in the pool and vertically defining flow path means requiring said flow path to pass below a desired depth of said pool, and said flow of condensed vapor constrained by said flow path means to discharge into an annular region of said pool, said annular region spaced apart from the periphery of said pool.

12. The pump of claim 11 wherein the jet assembly is mounted above the heating wall for the pool to be substantially thermally isolated from the heating wall.

13. The pump of claim 11 wherein the jet assembly and body assembly are mounted on a shelf above the heating wall for the pool to form an annular reservoir for the downwardly flowing liquid, the reservoir being thermally isolated from the heating wall for the pool, the flow path providing means for the liquid including a return tube extending downwardly from the reservoir toward the region of the axis for providing a flow path for overflow liquid in the reservoir.

14. The pump of claim 13 wherein the jet assembly is mounted completely above the surface of the pool and is substantially thermally isolated from the means for applying heat, a fore line adapted to be connected to a fore pump, said fore line including a cool wall and a plurality of baffle plates substantially thermally isolated from the cool walls of the fore line and body assembly so that the baffle plates are warm enough to boil away substantially all high vapor pressure materials contacting them while condensing the diffusion pump fluid vapor contacting them, and means for providing a flow path for the condensed vapor from the plates to the reservoir.

15. The pump of claim 11 wherein the flow path providing means for the liquid includes a dome having an apex substantially on the axis and wall means that taper outwardly and downwardly from the apex.

16. The pump of claim 15 wherein the dome includes a portion extending outwardly and downwardly in the pool.

17. The pump of claim 16 wherein said vertically defining flow path means comprises a separator tube extending into the pool outside of the outwardly extending dome portion.

18. The pump of claim 17 wherein the dome portion is semi-hemispherical and includes an apex substantially on the axis and the tube is cylindrical so that the end of the tube and the dome form an annular orifice in the pool.

19. A diffusion pump wherein liquid from a pool of diffusion pump fluid is heated by a boiler to a vapor that rises through a jet assembly and thence is emitted through a nozzle means against a cool wall where it is condensed to form a condensate that flows downwardly along the wall back to the pool, the improvement comprising means for providing a flow path for the condensate from the cool wall to a central region of the pool, the boiler including means for applying heat to liquid in a peripheral portion of the pool and means for providing a substantially unidirectional convection flow of the condensate through the pool from the central region toward the peripheral pool portion.

20. The pump of claim 19 wherein the means for providing the unidirectional flow includes a downwardly and outwardly extending fluid passageway.

21. The pump of claim 19 wherein the heat is applied for a substantial vertical distance along the peripheral pool portion.

22. The pump of claim 19 further including a fore line adapted to be connected to a fore pump, said fore line including a cool wall and a plurality of baffle plates substantially thermally isolated from the cool walls of the fore line and body assembly so that the baffle plates are warm enough to boil away substantially all high vapor pressure materials contacting them while condensing the diffusion pump fluid vapor contacting them, and means for providing a flow path for the condensed vapor from the plates to the pool.

23. A diffusion pump wherein liquid from a pool of diffusion pump fluid is heated by a boiler to a vapor that is ejected into a fore line having a cool wall and baffle plates, said vapor also rising through a jet assembly and thence being emitted through a nozzle means against a cool body wall where it is condensed to form a condensate that flows downwardly along the wall back to the pool, the improvement comprising means for substantially thermally isolating the baffle plates from the cool body and fore line walls so that the baffle plates are warm enough to boil away substantially all high vapor pressure materials contacting them, and means for providing a flow path for the condensed vapor from the plates to the reservoir said thermal isolating means including a sleeve spaced from and located inside of the cool wall of the fore line.

24. The pump of claim 23 wherein the thermal isolating means includes a vacuum space between the plates and the cool wall of the fore line.

25. The pump of claim 23 wherein the jet assembly is mounted completely above the surface of the pool and is substantially thermally isolated from the means for applying heat.

26. A diffusion pump wherein liquid from a pool of diffusion pump fluid is heated by a boiler to a vapor that rises through a jet assembly and thence is emitted through a nozzle means against a cool wall where it is condensed to form a condensate that flows downwardly along the wall back to the pool, the jet assembly being mounted completely above the surface of the pool so that no part of the jet assembly contacts the pool, an improved jet assembly comprising a conduit providing a flow path for the vapor to a diffusion nozzle of the nozzle means, the conduit having an opening below apertures in the jet assembly through which the vapor passes so that a tortuous path is provided for the vapor from the apertures to said diffusion nozzle.

* * * * *